US006032498A

United States Patent [19]

Sherlock et al.

[11] Patent Number: 6,032,498

[45] **Date of Patent: *Mar. 7, 2000**

[54] SECURITY SYSTEM FOR USE ON THE BEACH

[76] Inventors: Thomas M. Sherlock, 27260 Sherlock Rd., Los Altos Hills, Calif. 94022; Eric W. Kramer, 730 College Ave., Palo Alto, Calif. 94306

[ * ] Notice: This patent is subject to a terminal disclaimer.

[21] Appl. No.: 09/025,591

[22] Filed: Feb. 18, 1998

Related U.S. Application Data

[63] Continuation-in-part of application No. 08/257,504, Jun. 8, 1994, Pat. No. 5,501,086, and a continuation of application No. 08/480,576, Jun. 7, 1995, Pat. No. 5,740,684.

[51] Int. Cl.[7] ..... E05B 73/00

[52] U.S. Cl. ..... 70/58; 52/157; 52/155

[58] Field of Search ..... 70/14, 18, 19, 70/57, 58, 63, 32, 34, 158–177; 109/45, 50–52; 248/156, 530, 532, 545, 551–553; 52/155, 157, 165, 166

[56] References Cited

U.S. PATENT DOCUMENTS

| | | | |
|---|---|---|---|
| 3,986 | 4/1845 | Mitchell | 52/157 |
| 501,811 | 7/1893 | Stombaugh | 52/157 |
| 841,812 | 1/1907 | Pement | 52/157 |
| 865,044 | 4/1907 | Birch | 52/157 |
| 995,297 | 6/1911 | Schroeder | 52/157 |
| 1,283,246 | 10/1918 | Maloney | 52/157 |
| 1,308,939 | 7/1919 | Eggleston | 52/155 |
| 2,462,951 | 3/1949 | Doubble | 70/180 |
| 2,887,195 | 5/1959 | Jackson | 189/90 |
| 3,067,846 | 12/1962 | Luebkeman | 189/91 |
| 3,295,274 | 1/1967 | Fulton | 52/148 |
| 3,727,438 | 4/1973 | Knaack | 70/63 |
| 3,736,711 | 6/1973 | Thornbrugh | 52/149 |
| 3,797,283 | 3/1974 | Honer | 70/58 |
| 4,023,387 | 5/1977 | Gould | 70/233 |
| 4,031,722 | 6/1977 | Michelman et al. | 70/63 |
| 4,118,903 | 10/1978 | Sexton | 52/57 |
| 4,302,955 | 12/1981 | Kawakami | 70/30 |
| 4,389,034 | 6/1983 | Suttles | 248/49 |
| 4,562,707 | 1/1986 | Graham, III | 70/58 |
| 4,573,332 | 3/1986 | Ma | 70/30 |
| 4,778,142 | 10/1988 | Roba | 52/157 X |
| 4,790,109 | 12/1988 | Whidden | 52/157 X |
| 4,867,478 | 9/1989 | Anderson | 280/814 |
| 4,907,522 | 3/1990 | Lutzke | 114/230 |
| 4,998,849 | 3/1991 | Summers | 52/157 X |
| 5,139,235 | 8/1992 | Kilmer | 256/36 |
| 5,143,114 | 9/1992 | Daniels | 137/385 |
| 5,240,353 | 8/1993 | Bowen et al. | 405/259.1 |
| 5,501,086 | 3/1996 | Sherlock | 70/58 |
| 5,740,684 | 4/1998 | Sherlock et al. | 70/58 |

FOREIGN PATENT DOCUMENTS

| | | | |
|---|---|---|---|
| 517809 | 5/1921 | France . | |
| 652831 | 1/1938 | Germany | 52/157 |
| 80147 | 3/1994 | Germany . | |
| 865044 | 1/1960 | United Kingdom . | |

*Primary Examiner*—Suzanne Dino Barrett
*Attorney, Agent, or Firm*—Townsend and Townsend and Crew LLP

[57] ABSTRACT

A security system for securing personal property at a beach including two augers is provided. A pair of augers (15,16, 50,100) are screwed into the sand. A crossbar (11,102) placed in loops (13,14,56) on the exposed ends of the augers. The crossbar is locked to the augers so that the augers may not be unscrewed from the sand. Items of personal property (31,140) may then be locked to the security device formed by the augers and crossbar.

11 Claims, 9 Drawing Sheets

SECURITY SYSTEM FOR USE ON THE BEACH

This application is a continuation of Ser. No. 08/480,576 filed Jun. 7, 1995 U.S. Pat. No. 5,740,684 and a continuation-in-part of application Ser. No. 08/257,504 filed Jun. 8, 1994 now U.S. Pat. No. 5,501,086.

BACKGROUND OF THE INVENTION

This invention, generally, relates to devices for securing items of personal property in open areas having little or nothing to which to fasten such items and, more particularly, to a portable system for securing items to the ground or beach easily, conveniently and securely.

Theft of personal property is a perennial problem. Possibly the best the way to safeguard one's personal property is to watch over it. However, standing guard is not always a viable option. Therefore, a common alternative is to simply keep items of personal property locked up.

To secure an item with a lock, there should be a way to attach the item to a fixture. Such a fixture is something too large, too heavy, or too well-planted to be easily moved. For example, a suitable fixture might be a portion of a building like a floor or wall, a heavy safe or, outdoors, it might be a utility pole or tree.

A determined thief with the right tools and enough time can defeat most security devices. However, if defeating a security device poses a clear time-consuming situation to a thief, the thief will be deterred—even if just to seek easier prey elsewhere. Therefore, a security device does not have to be theft-proof to be effective.

A particularly troublesome type of theft is the theft of personal property from individuals at the beach because they cannot keep possessions with them while engaged in beach recreational activities (e.g., swimming). Locking up personal property is often not an option because of a lack of fixtures on the beach for securing personal property. Although an alarm may be utilized, an alarm system is not likely to be effective by itself because even if the owner heard an alarm, the thief would likely escape with the items of personal property by simply mingling with the beach crowd.

A security system is needed that allows beach goers to secure their personal property on the beach. As few beaches offer areas for securing personal property, the security system should allow a user to secure her property without requiring special areas or fixtures at the beach. The security device should take enough time to defeat that thieves are deterred from attempting to steal the secured personal property. The present invention fulfills this and other needs.

SUMMARY OF THE INVENTION

The present invention provides an innovative security system for securing personal property at the beach. The security system secures the personal property without requiring special fixtures at the beach for this purpose. The present invention utilizes a pair of augers which are screwed into the sand. Personal property is then secured to the augers and a locking mechanism prevents the augers from being unscrewed from the sand. The security system is easy to install yet provides a deterrent to thieves.

In a preferred embodiment, the security system of the present invention includes a pair of augers each having a spiral blade at one end and a loop or hole at the other end. After the augers are screwed into the sand, a crossbar is placed through each of the loops in the exposed ends of the augers and personal property is secured to the bar. At one end, the bar is too large to pass through the loops in the augers and at the other end, the bar includes a hole through which a padlock may be placed. The personal property is secure because the padlock secures the bar to the augers while preventing the augers from being unscrewed from the sand. Additionally, the bar may be placed through the loops in the augers to facilitate screwing the augurs into the sand.

The present invention also provides a folding auger that has a joint between the ends of the auger. In one embodiment, the joint comprises a pair of loops that join two bars comprising the auger. The joint allows the auger to be folded for more compact storage and also allows the auger to be folded at a right angle so the bar of the auger opposite the spiral blade may be utilized to facilitate screwing the auger into the sand.

The present invention provides a container for securing items of personal property. The container includes a body and a cap. After items are placed in the body, the cap is placed on the body. The body and cap each have a pair of holes that are aligned so that a bar or other locking mechanism passes through the holes to secure the items in the container. Additionally, the container may include a carrying strap that is attached to the body at one end and the cap at the other so that tension on the carrying strap holds the cap on the body during transport.

The present invention also provides a valve lock that locks a tank having a valve (e.g., scuba tank). The valve lock is placed over the valve on the tank and has two holes therethrough. When the valve lock is placed over the valve, a bar or other locking mechanism passes through the holes in the valve lock to secure the tank.

The present invention provides a pivot clamp that locks a case having padlock holes. The pivot clamp is clamped onto the padlock holes of the case and has two holes therethrough. When the pivot clamp clamps onto the padlock holes, a bar or other locking mechanism passes through the holes in the pivot clamp to secure the case.

A security system of the present invention may include a pair of augers and a crossbar that locks the augers into the sand. The crossbar may pass through holes in a container to secure items of personal property. The crossbar may also pass through a valve lock to secure a scuba tank. Additionally, the crossbar may pass through a pivot clamp to secure a case having padlock holes. Such a security system is shown in FIG. 12.

Accordingly, it is an object of the invention to provide a security system for use on open ground areas to secure personal property. It is also an object of the invention to provide a portable and low cost security system for securing property on a beach. It is another object of the invention to provide a security system which the owner can readily install and remove.

Further aspects and advantages of the present invention will become readily apparent upon a perusal of the following description with reference to the accompanying drawings.

DESCRIPTION OF THE PREFERRED EMBODIMENT

The present invention provides a security system for securing personal property at the beach. In the description that follows, the present invention will be described in reference to securing specific items of personal property. The personal property has been chosen for illustration purposes and the present invention is not limited to any specific items. Furthermore, the present invention may be utilized to secure objects at places other than the beach (e.g., other loosely packed ground surfaces like snow). Therefore, the description that follows is for illustration and not limitation.

Figure 1:
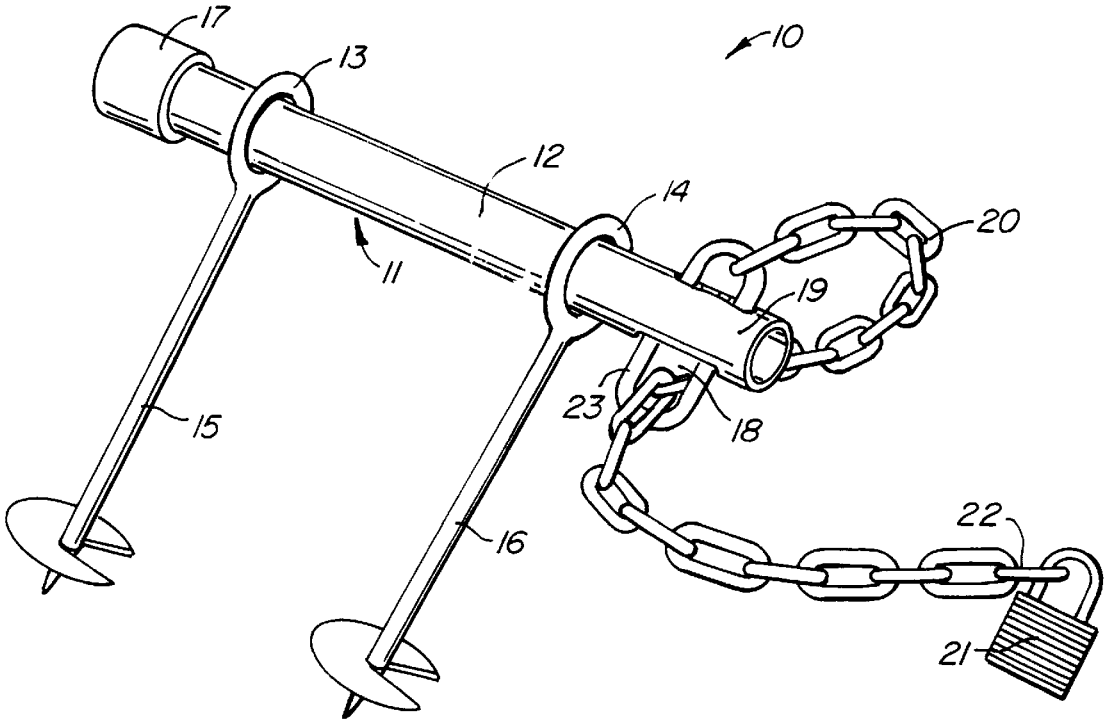
FIG. 1 is an illustration of a security device constructed and arranged in accordance with the present invention.

Referring to FIG. 1, a security device constructed according to the present invention is identified generally by the reference numeral 10. A crossbar 11 (or bridge bar) has a body 12 formed to fit readily through loops 13 and 14 in one end of each of two augers 15 and 16, respectively, so neither auger can be removed after being installed.

A cap 17 is affixed firmly to an end of the crossbar 11 so that it cannot be removed easily. The body 12 of the crossbar 11 has an outside diameter smaller than the inside diameter of either loop 13 or 14. An opening 18 is formed in the opposite end 19 of the crossbar 11 to receive a link of a chain 20.

A padlock 21 is attached to one end 22 of the chain 20, and the other end of the chain 20 has an elongated end link 23 to fit through the opening 18, which is a slotted opening in this form of the invention. The end link 23 protrudes from the opening 18, where it receives the chain 20, as shown in FIG. 1. The padlock 21 is used to attach the chain 20 of the security device 10 to an item of personal property, which will be described in more detail as the description proceeds.

Figure 2:
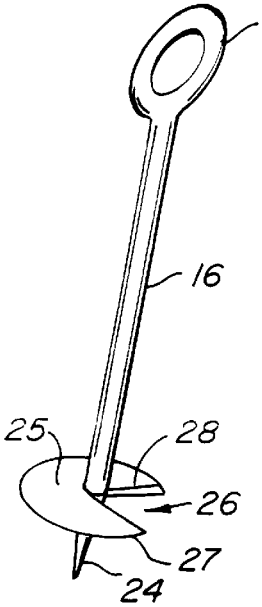
FIG. 2 is an illustration of component parts that form one of the augers constructed according to the invention.

Now referring to FIG. 2, the auger 16 is shown in more detail as having its lower end 24 chisel-shaped for more effective penetration in the ground than a point or other symmetrically shaped end. Also visible in this view is the loop 14 being formed integrally with the auger 16 to provide a maximum of strength.

A single spiral blade 25 is fixedly attached at the other end of the auger 16. The auger 16, typically, is made of steel to provide a still further increase in strength. In one embodiment, the augers 15 and 16 both are 30 inches from end to end with each of the blades being three inches in diameter.

The diameter of the loop 14 accommodates the crossbar body 12 (see FIG. 1) and in one embodiment the loop 14 is one inch in diameter. The blade 25 preferably is circular in configuration and has a notch 26 to form edges 27 and 28. The edge 27 is slightly lower than the edge 28 and is sharper to ease its cutting action when rotated in a counterclockwise direction. In another embodiment, the augers are constructed to be inserted with a clockwise rotation.

Figure 3:
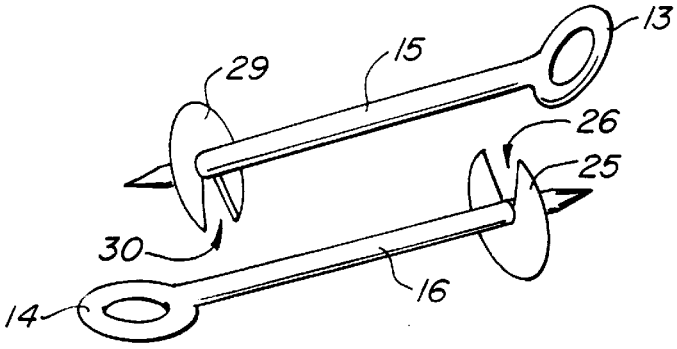
FIG. 3 is an illustration of two of the rods of the invention arranged to permit storage to save space when not in use.

More details for the augers 15 and 16 are shown in FIG. 3. By positioning the augers 15 and 16 as shown, two such augers can be stored together to save storage space. To fit together, the blades 25 and 29 have gaps 26 and 30, respectively. For storage and transport, one auger is inserted in the gap of the blade on the other auger.

Figure 4:
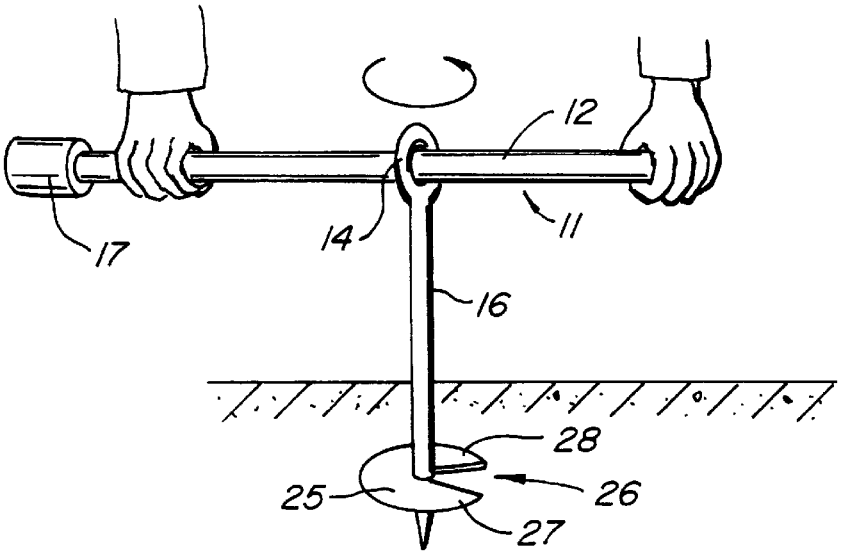
FIG. 4 is an illustration of the crossbar being used to install one of the augers into the sand or ground.

Referring next to FIG. 4, to use the security device 10, the first step is to screw an auger into the ground, which can be soil, sand, snow, or the like. This may be facilitated by inserting the crossbar 11 through a loop and using the crossbar body 12 as a handle, rotating the rod in a counterclockwise direction, whereby the single blade 25 screws the auger into the ground.

A user may grasp both ends of the crossbar 11 in order to achieve a balance in the mechanical forces in harder or more packed soil. Of course, it will be much easier in loose sand, in which case a user may insert the crossbar 11 all the way through the loop and rotate the crossbar with one hand.

As an example, each of the augers may be screwed into the ground until about six inches of the rod is left above the surface. Of course, in firmer soil, more of the rod can be left above the ground surface.

Figure 5:
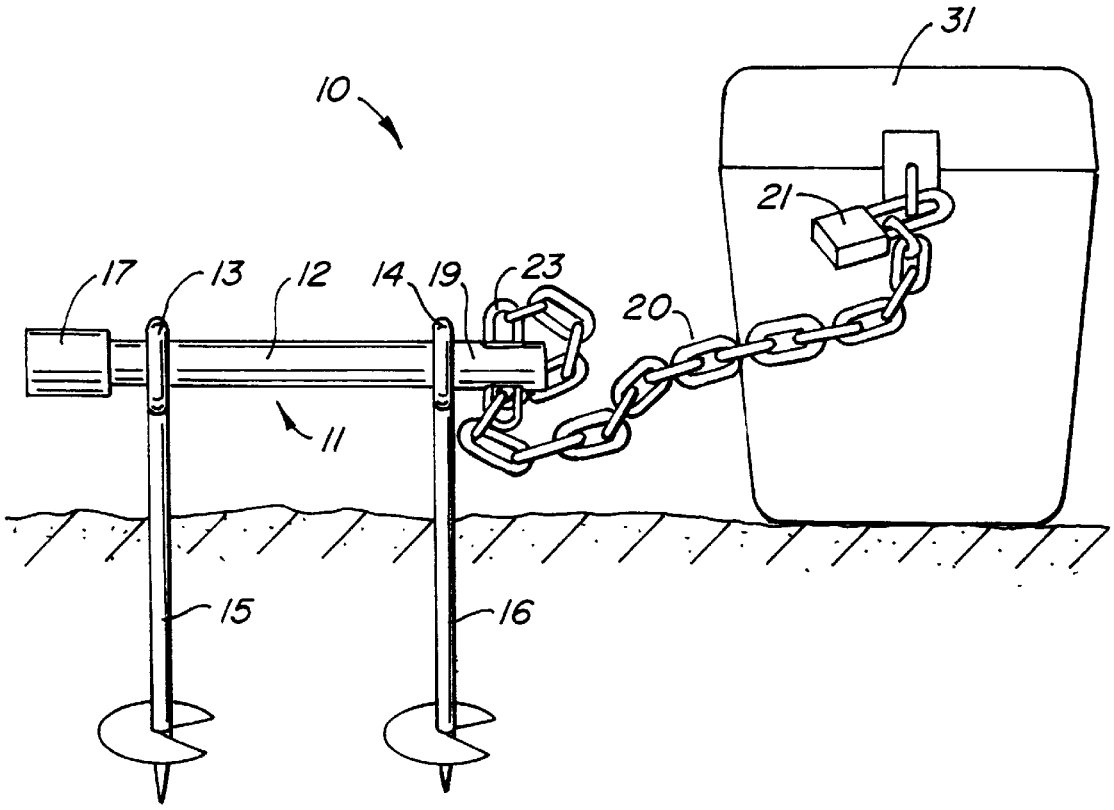
FIG. 5 is an illustration showing a security device of the invention with an item of personal property attached.

FIG. 5 illustrates the security device 10 of the invention after installation is complete. This view shows that the two augers are spaced closer than the length of the crossbar 11.

Then, the end link 23 of the chain 20 is inserted into the opening 18 in the crossbar 11. The end link 23 protrudes through the opening 18 and the chain 20 is passed through the protruding portion of the end link 23.

Finally, an item 31 of personal property to be secured is attached to the end of the chain 20 using the padlock 21. When installed as described, the crossbar 11 prevents either of the augers from being unscrewed.

To defeat the security device 10 of the invention, as described hereinabove, the augers may be uprooted, which requires substantial force, or the augers may be dug out, which requires substantial time. Tests of a prototype device confirmed that the security device 10 offers a significant deterrent to theft when installed as described.

Attempting to dig out the device 10 from sand is difficult because the sand tends to flow into a narrow hole. Consequently, a large time consuming excavation must be made.

Figure 6:
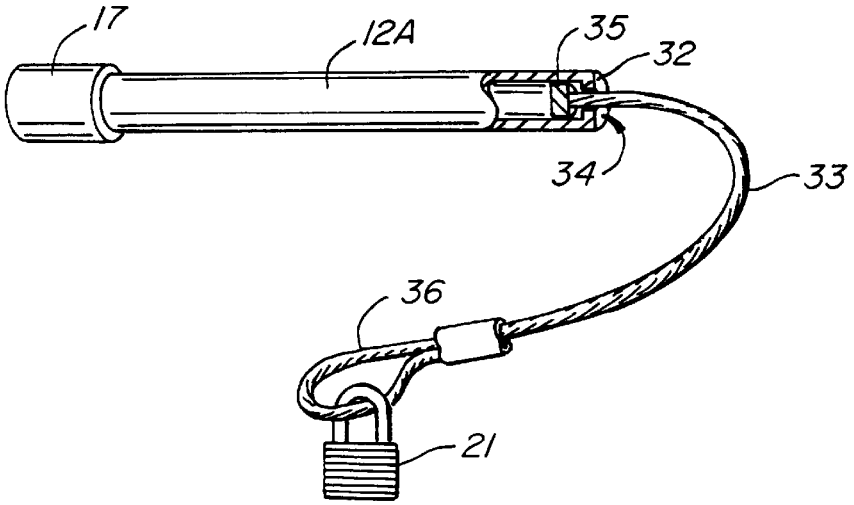
FIG. 6 is an illustration of a modification for the crossbar with a cable attached.

Modifications of the security device 10 are possible within the scope of the invention. For example, as shown in FIG. 6, a modified crossbar 12A is formed with a hollow, tubular steel body having an integral partial closure 32 at the end opposite the cap 17. A thin, steel cable 33 is passed through a hole 34 in the partial closure 32.

The cable 33 is prevented from being removed through the hole 34 by permanently attaching a stop 35 to the cable end within the crossbar 12A. The free end of the cable 33 has a woven loop 36 to which the padlock 21 is attached.

An advantage of this modified crossbar is that the cable 33 is permanently attached to the bar and may be at least partially stored within the bar. If the crossbar 12A is pulled out of the loops on the augers, the augers might be partially unscrewed, but the cables twists up and prevents unscrewing beyond a few turns.

A further modification to which the present invention is capable of effective use is in combination with other deterrents to theft. For example, a lockable compartment can be added to the bottom of an ice chest to enclose extra weight, such as a quantity of sand or other material that may be available at the use site.

Figure 7C:
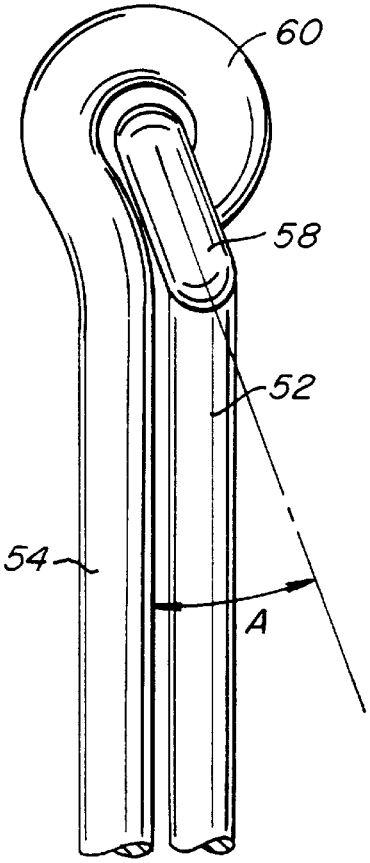
FIG. 7C is a side view of the folding auger folded.
Figure 7B:
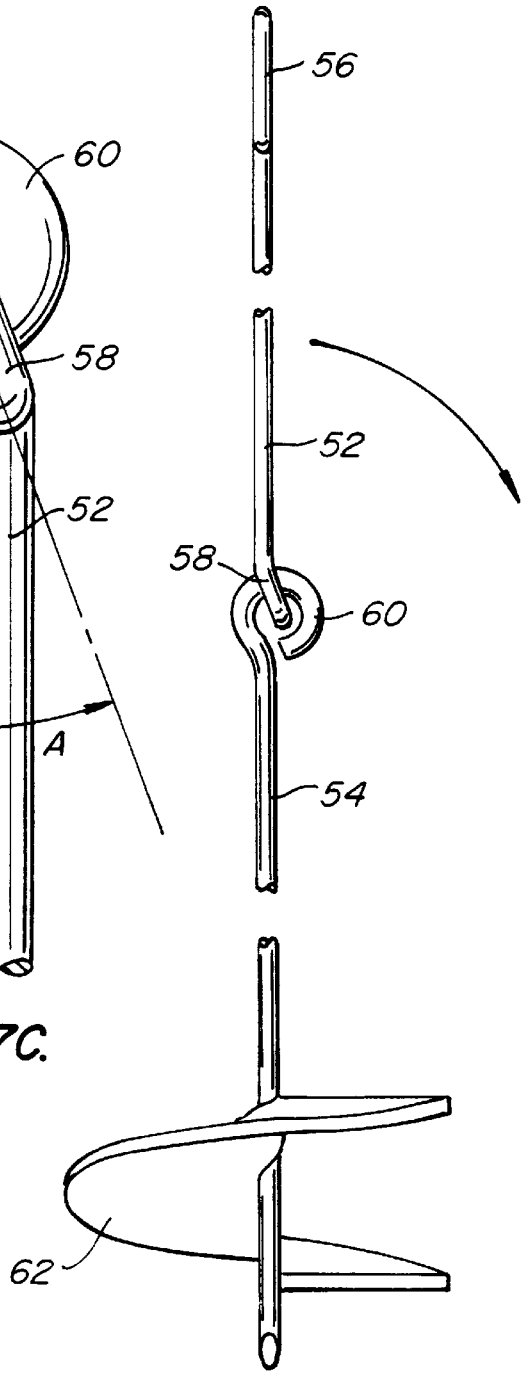
FIG. 7B is a side view of the folding auger.
Figure 7A:
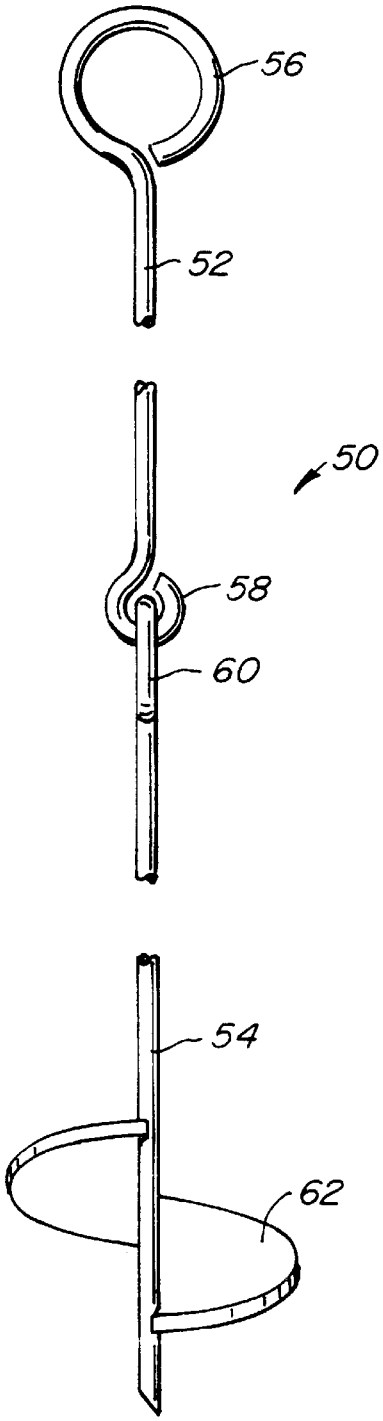
FIG. 7A is an illustration of a folding auger.

FIGS. 7A–7C show a folding auger of the present invention. As shown in FIG. 7A, an auger 50 has an upper bar 52 and a lower bar 54. The upper bar 52 has a loop 56 at one end and a loop 58 at the other end. The loop 56 is used to secure personal property and a crossbar may be placed in the loop to screw in the auger. The lower bar 54 has a loop 60 at one end and a spiral blade 62 at the other end. The loops 58 and 60 form a joint to link the upper and lower bars of the auger together.

FIG. 7B shows a side view of the folding auger. The arrow indicates that the upper bar 52 may be folded down to the lower bar 54. The spiral blade 62 may be formed with a gap to allow the upper bar 52 of the auger to be folded into the gap for more compact storage. Additionally, the auger may be formed with more than one spiral blade. In one embodiment, the folding auger is 42 inches long with a spiral blade 2.4 inches in diameter.

In a preferred embodiment, the loop 58 is formed on the upper bar 52 at an angle A (oblique) as shown in FIG. 7C. The angled loop allows the upper and lower bar of the auger to be folded flat against each other. When extended, the upper and lower bars of the folding auger are in a straight line (collinear) which facilitates screwing in the auger.

The joint in the folding augers also provides a way to screw the augers into the sand. The upper bar 52 may be placed at a right angle to the lower bar 54. Then, the upper bar may rotated to screw the lower bar into the sand. The joint also allows the folding augers to be secured in different configurations as shown in FIGS. 8A–8C.

Figure 8A:
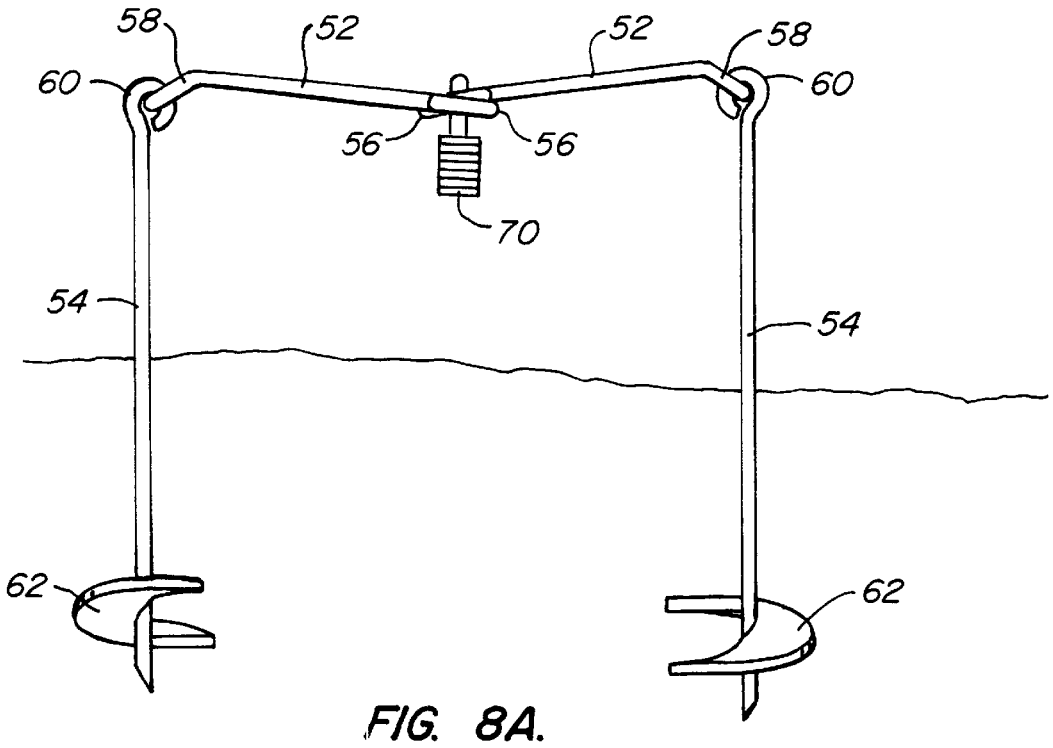
FIG. 8A is an illustration of locked folding augers.

FIG. 8A shows a pair of folding augers locked together with a padlock 70. After the lower bars 54 of the folding auger have been screwed into the sand or other substance, the upper bars 52 may be folded together and locked with the padlock 70 in the loops 56. In this configuration, the upper bars 52 of the augers serve as the crossbar since they may aid in screwing in the augers and when locked will restrict the augers from being rotated or unscrewed.

Figure 8B:
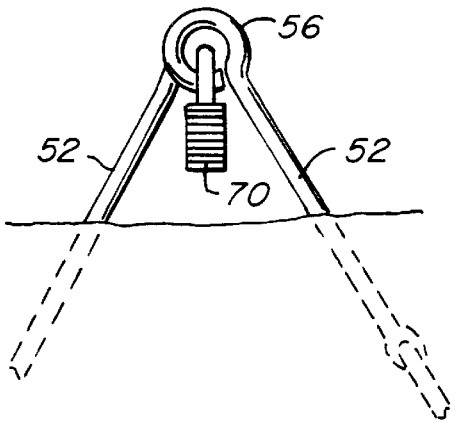
FIG. 8B is another illustration of locked folding augers.
Figure 8C:
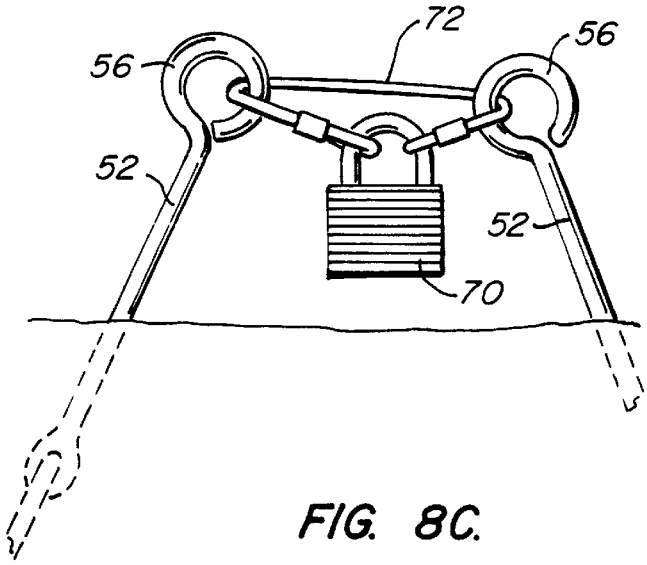
FIG. 8C is another illustration of locked folding augers.

In another configuration shown in FIG. 8B, two folding augers are placed in the sand at angles so that the loops 56 may be locked by the padlock 70. FIG. 8C shows another configuration where a cable 72 is utilized to lock the loops 56 of the folding augers together. The cable 72 should be tight enough so that the cable will twist up if one attempts to unscrew an auger thereby preventing the augers from being unscrewed.

Figure 9A:
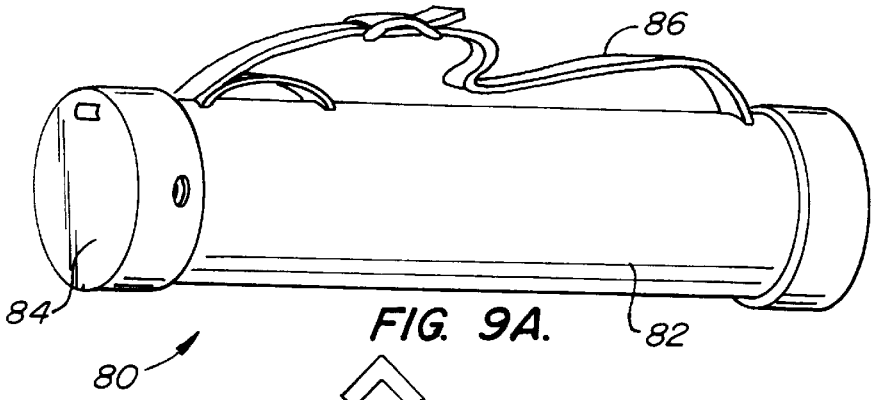
FIG. 9A is an illustration of a lockable container.
Figure 9B:
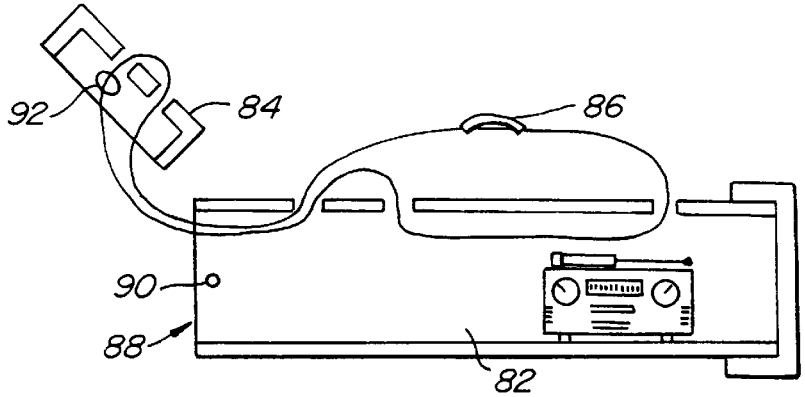
FIG. 9B is a cross-sectional view of the lockable container.
Figure 9C:
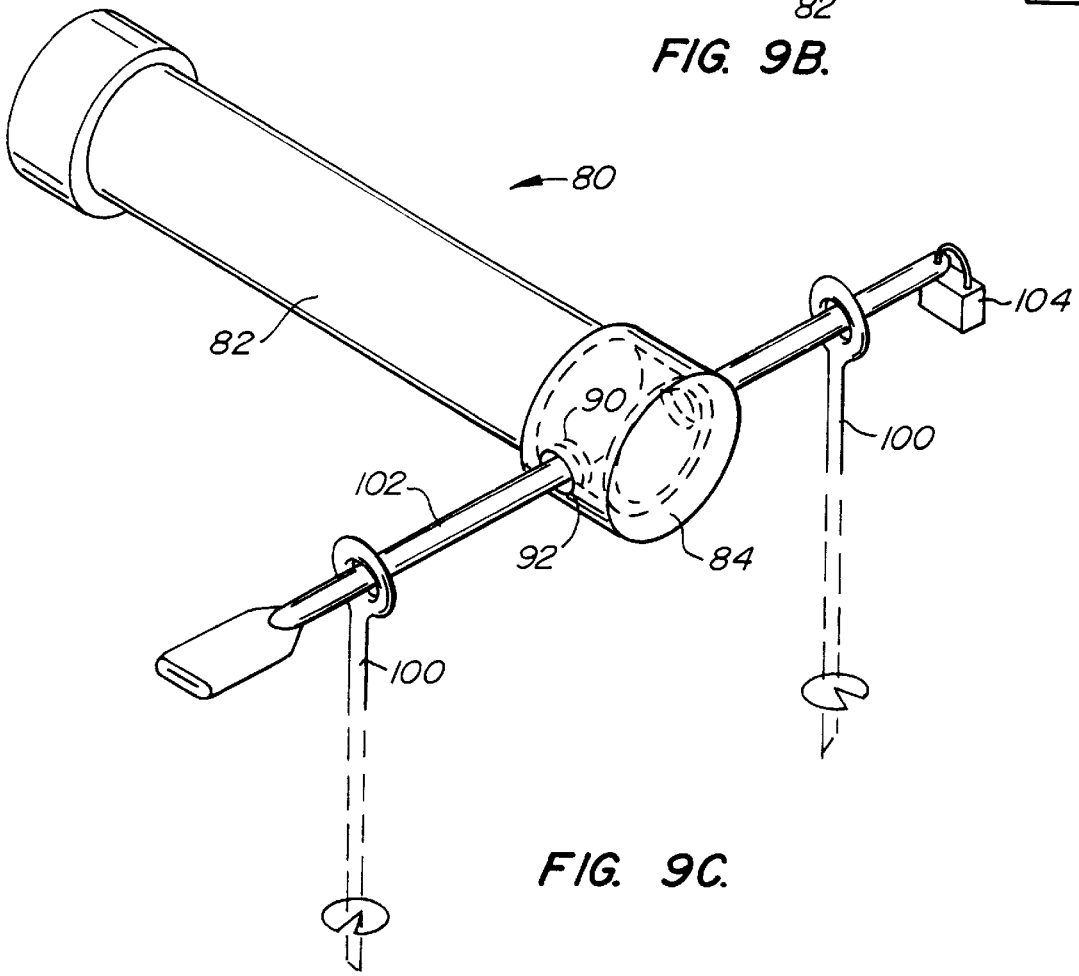
FIG. 9C is an illustration of the lockable container secured on a beach.

FIGS. 9A–9C show a lockable container according to the present invention. In FIG. 9A, a container 80 has a body 82 and a cap 84. The container 80 also includes a carrying strap 86 which is attached to the body 82 and the cap 84. In a preferred embodiment, the container 80 is utilized to carry the security system of the present invention to the beach. Therefore, the container may hold augers, a crossbar, a padlock, a chain, a cable, or other items depending on the configuration of the system. Once these items are removed from the container, the container may be utilized to store personal property as shown in FIGS. 9B and 9C.

FIG. 9B is a cross-sectional view of the container 80. As shown, the carrying strap 86 passes through slits in the body 82 and slits through the cap 84. The carrying strap is attached to the body and cap so that when tension is placed on the carrying strap (e.g., when the carrying strap is placed over one's shoulder), the cap is retained over an opening 88 in the body 82. Items may be placed in the container 82 through the opening 88.

Additionally, the container has holes through the body 82. A hole 90 is shown in the cross-section but there is a hole in each wall of the body. The cap 84 has holes that correspond to the holes in the body 82. A hole 92 is shown in the cross-section but there is a hole in each wall of the cap. The holes are utilized to secure the container and objects placed inside the container.

In FIG. 9C, the container is shown secured utilizing two augers 100, a crossbar 102, and a padlock 104. As shown the crossbar 102 passes through the holes in the body 82 and the cap 84. The holes prevent the cap from being removed from the body of the container without first sliding the crossbar 102 out of the holes. The carrying strap is optional and is not shown in FIG. 9C.

Figure 10C:
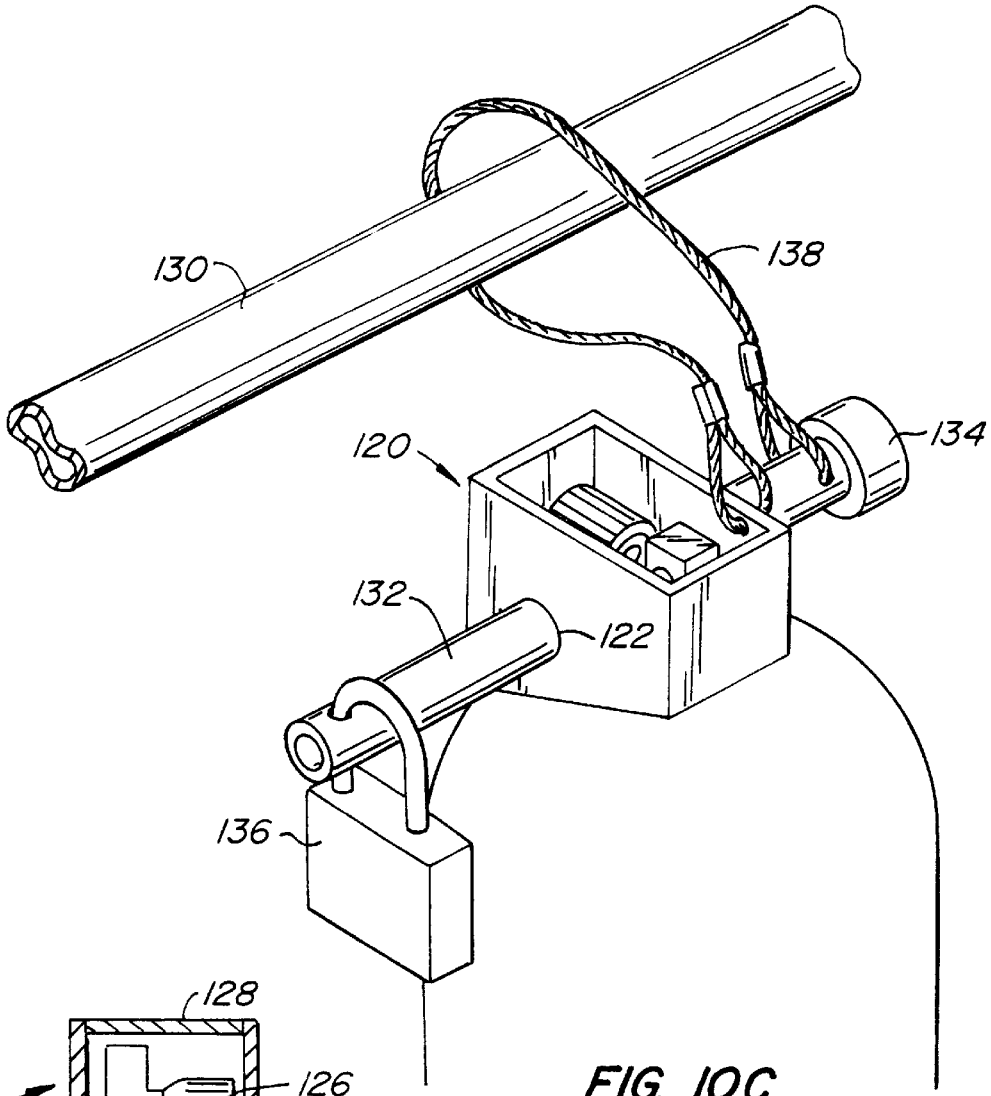
FIG. 10C is an illustration of a valve lock securing a scuba tank to a railing or fixture.
Figure 10B:
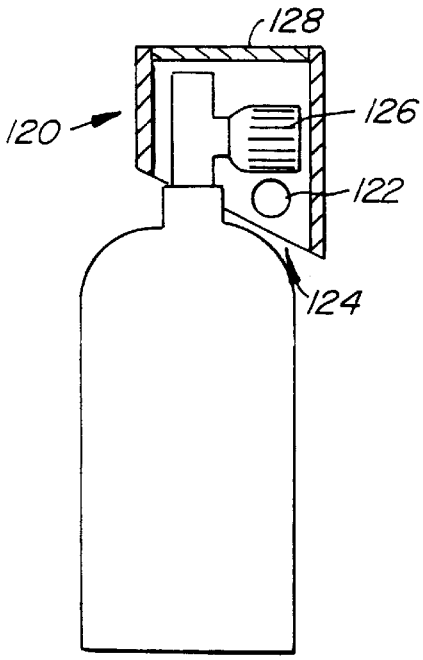
FIG. 10B shows the valve lock on a scuba tank.
Figure 10A:
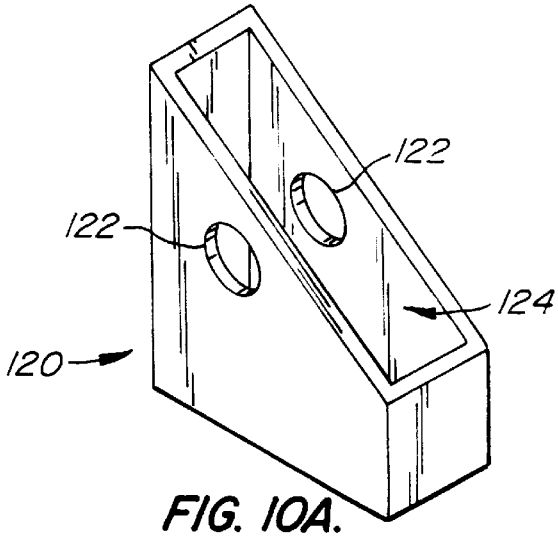
FIG. 10A is an illustration of a valve lock for scuba tanks.

FIGS. 10A–10C show details of a valve lock that may be utilized to secure a tank having valves like a scuba tank. FIG. 10A shows a valve lock 120 that includes holes 122 that pass through the valve lock. The valve lock 120 has an opening 124 that is placed over the valve of a scuba tank as shown in FIG. 10B. As shown, the bottom surface defining the opening 124 in the valve lock has angled surface to better fit on the top of a scuba tank.

When the valve lock 120 is placed on the top of a scuba tank, the holes 122 in the valve lock are located under a valve knob 126. Thus, when a crossbar or other locking mechanism is placed in the holes 122, the valve lock secures the scuba tank because the locking mechanism is under the valve knob 126 which prevents the valve lock from being removed from the scuba tank. The valve lock in FIG. 10B is shown with an optional top 128. In one embodiment, multiple valve locks are cut from an rectangular tube of aluminum where two valve locks may be cut from each rectangular piece of the tube.

In a preferred embodiment, the valve lock of the present invention is utilized with the security devices described herein. However, the valve locks may also be utilized to lock a scuba tank (or any other valved tank like a propane tank) to a fixture. In FIG. 10C, the valve lock 120 secures a scuba tank to a fixture 130 which here is a bar from a railing on a boat. A bar 132 is placed through holes 122 and the bar is held in place by a cap 134 and a padlock 136. A cable 138 is attached at one end to the bar 132 and to the valve lock 120 at the other end. Since the cable 138 is looped around the fixture 130, the scuba tank is secured to the fixture. Thus, the valve locks of the present invention may be utilized in many number of ways.

Figure 11:
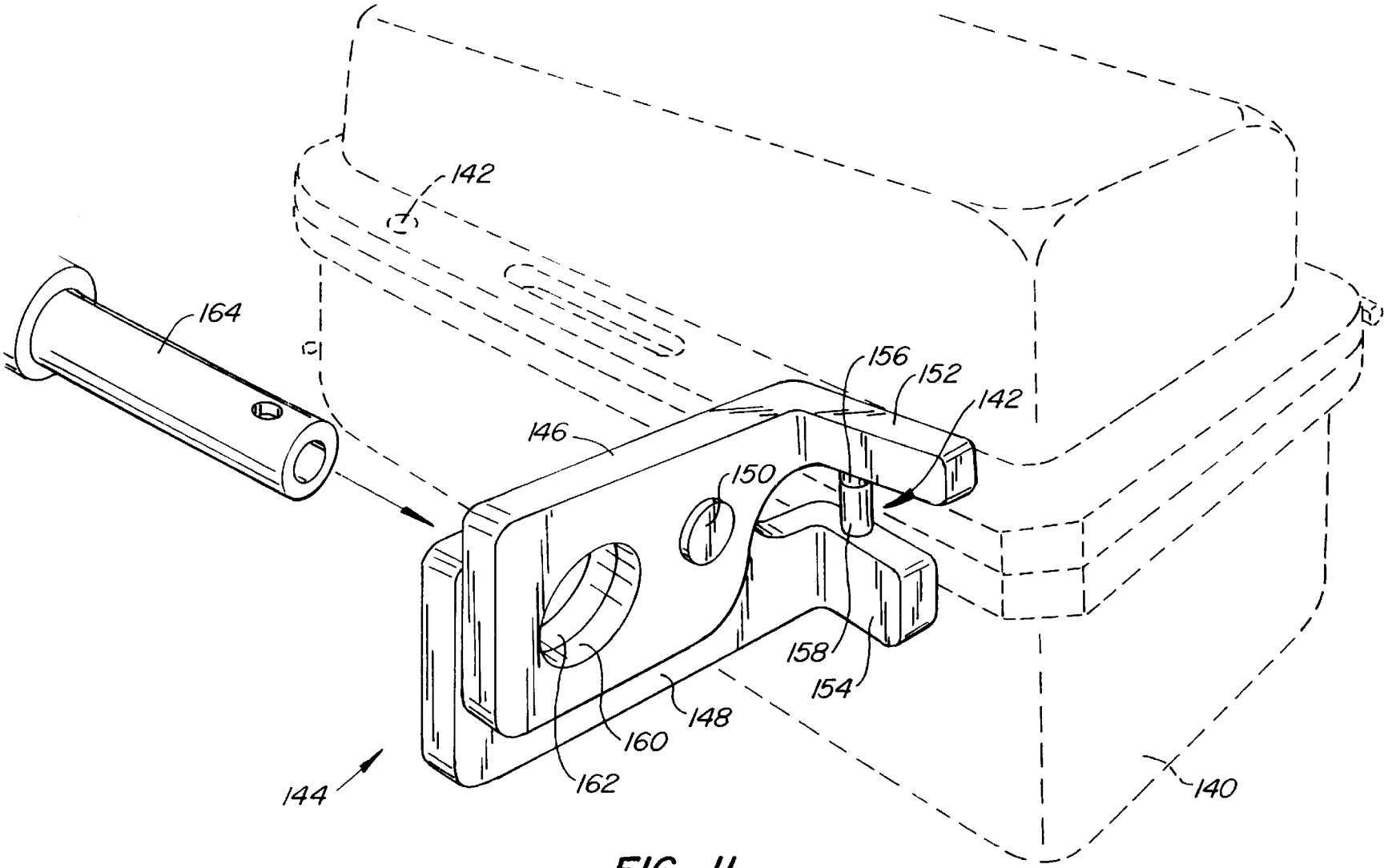
FIG. 11 is an illustration of a pivot clamp for securing a case with padlock holes.

FIG. 11 shows a pivot clamp 144 that secures a case 140 having padlock holes 142. Many cases include padlock holes where the two halves of the case meet to allow a person to lock up the contents with a padlock. Although this will deter someone from opening the case, it does not deter a thief from stealing the case and opening the case elsewhere.

The pivot clamp 144 has an upper half 146 and a lower half 148. The upper half 146 and the lower half 148 are joined by a pivot pin 150. On one side of the pivot pin 150, the upper and lower halves of the pivot clamp have L-shaped extensions 152 and 154, respectively. L-shaped extension 152 has a circular protrusion 156 that extends into the padlock hole 142. Similarly, L-shaped extension 154 has a circular protrusion 158 that extends into the padlock hole 142. Although two circular protrusions are shown, a longer circular protrusion may be utilized that extends into a hole in the opposing L-shaped extension.

The upper half 146 and lower half 148 pivot about the pivot pin 150 so that the L-shaped extensions may be placed in the padlock hole 142. The upper half 146 has a hole 160 at the end opposite the L-shaped extension 152. Similarly, the lower half 148 has a hole 162 at the end opposite the L-shaped extension 154. When the pivot clamp 144 is placed on the padlock hole of the case 140, the holes 160 and 162 align so that a bar 164 or other locking mechanism may be placed through the aligned holes. Once a locking mechanism is secured in the holes 160 and 162, the pivot clamp may not be unclamped from the case 140.

In a preferred embodiment, the L-shaped extensions are utilized to make it more difficult for a thief to cut the case free. Although the holes 160 and 164 are described as being on the other end of the pivot clamp 144 from the padlock hole 142, the holes may also be placed between the pivot pin and the padlock hole in the case.

Figure 12:
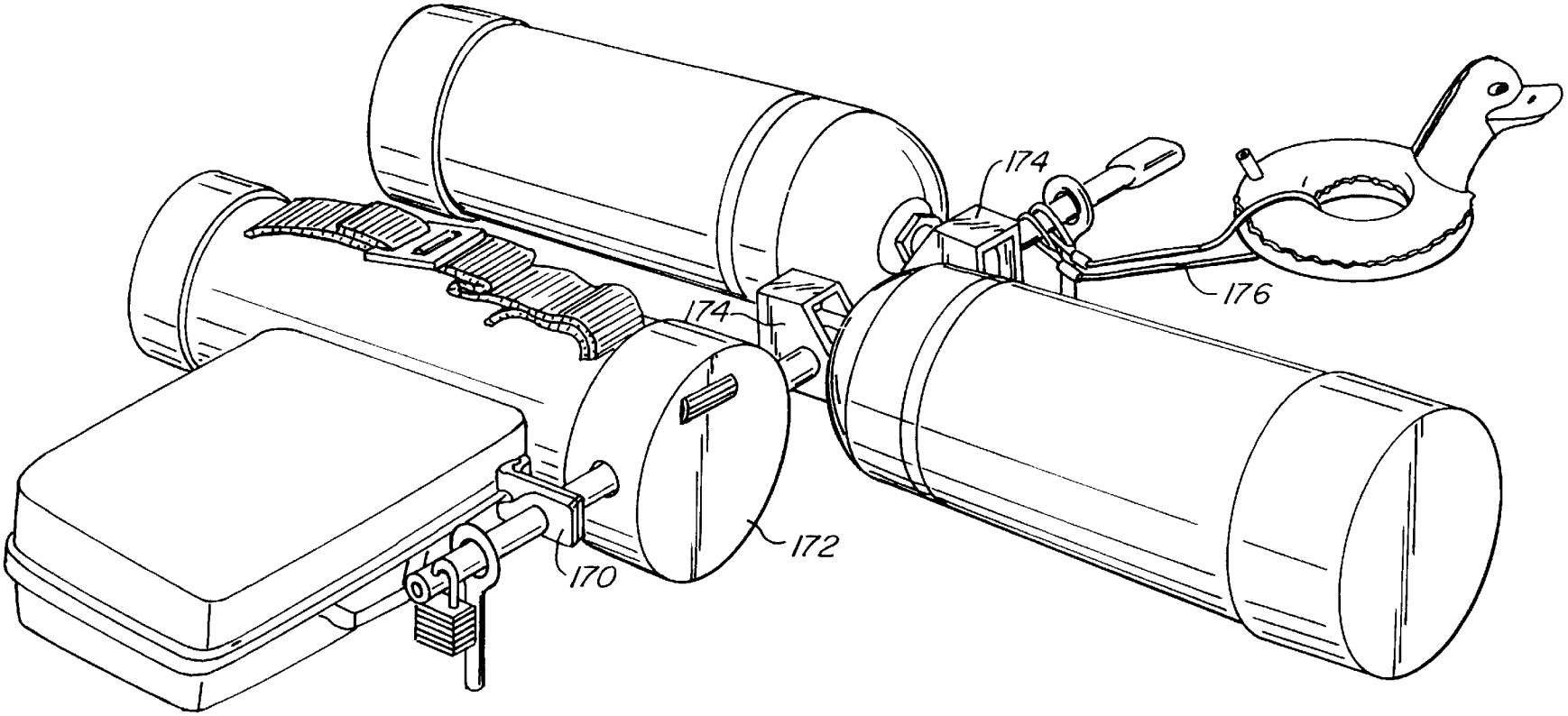
FIG. 12 is an illustration of a security system that secures personal property on the beach.

FIG. 12 shows a preferred embodiment of a security system of the present invention. A pivot clamp 170 secures a case with padlock holes. A lockable container 172 secures personal property (e.g., keys, wallet, or camera). Two valve locks 174 secure two scuba tanks. A steel cable 176 secures a floatation device. FIG. 12 is an illustration of the various objects that may be secured by a security system of the present invention.

Figure 13A:
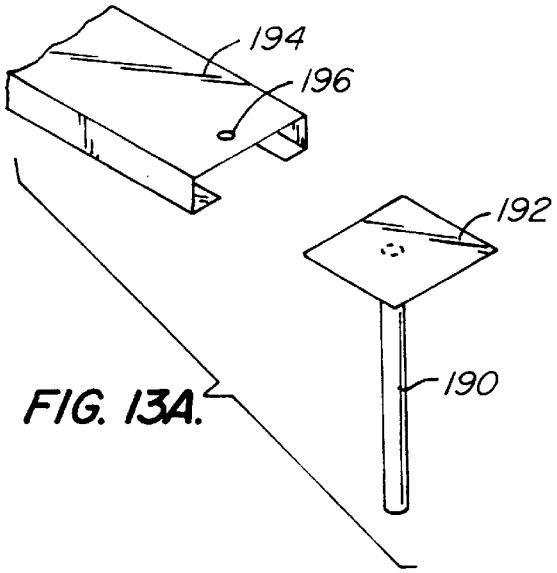
FIG. 13A is an illustration of an alternative structure for the upper end of an auger.
Figure 13B:
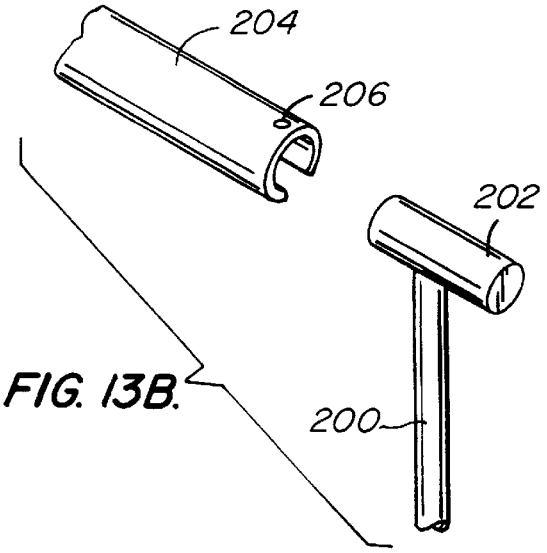
FIG. 13B is an illustration of another structure for the upper end of an auger.

In conclusion it can be seen that the present invention provides an innovative security system for securing personal property at the beach. While the above is a complete description of specific embodiments of the invention, various modifications, alternative constructions, and equivalents may be used. For example, the augers have been shown with loops but may also be constructed with holes or other structures on the upper ends. FIG. 13A shows an auger 190 with a square 192 welded to the top of the auger. A rectangular channel 194 may serve as the crossbar with a hole 196 for a padlock. Similarly, FIG. 13B shows an auger 200 with a bar 202 (could also be a hollow pipe) welded to the top of the auger. A pipe 204 may serve as the crossbar with a hole 206 for a padlock. These configurations allow the crossbar to both aid in screwing the augers into the sand and preventing the augers from being unscrewed from the sand. Also, the augers have been described as having a spiral blade which includes any type of threading. Therefore, the above description should not be taken as limiting the scope of the invention as defined by the claims.

What is claimed is:

1. An auger comprising:

a first bar;

a second bar coupled to the first bar at a non-detachable joint; and a spiral blade on an end of the second bar opposite the joint;

wherein the auger is foldable at the joint so that said first and second bars are flat against each other for compact storage.

2. The auger of claim 1, wherein the joint is formed by a loop on one end of the first bar linked with a loop on one end of the second bar, both of said loops being sufficiently closed to prevent detachment of said bars from one another.

3. The auger of claim 1, wherein the spiral blade includes a gap so that the first bar folds into the gap when the auger is folded flat.

4. The auger of claim 2, wherein a first loop of the joint is formed so that said first loop is in a separate plane from a second loop, said second loop being angled away from an axis of said first and second rods when said rods are extended, and said second loop being angled toward an opposite one of said rods when said rods are folded flat against each other.

5. The auger of claim 2 wherein said loops are offset so that said bars are coaxial when extended.

6. The auger of claim 4 wherein a center of said first loop is offset from an axis of the rod said first loop is attached to, and the portion of said second loop which passes through said first loop is offset from an axis of the rod on which said second loop is formed, such that said rods fold flat against each other when folded.

7. The auger of claim 1 wherein said joint is configured to allow said first bar to rotate in any plane.

8. The auger of claim 2 wherein said first bar is rotatable to a right angle with said second bar such that it can be used to screw said second bar into the ground.

9. The auger of claim 2 wherein one of said loops has an inside diameter small enough so that the inside diameter does not extend beyond a plane of the outside edge of the rod of the other loop when folded.

10. An auger comprising:

a first bar;

a second bar coupled to the first bar at a non-detachable joint; and a spiral blade on an end of the second bar opposite the joint;

wherein the auger is foldable at the joint so that said first and second bars are flat against each other for compact storage;

wherein the joint is formed by a loop on one end of the first bar linked with a loop on one end of the second bar, both of said loops being sufficiently closed to prevent detachment of said bars from one another;

wherein a first loop of the joint is formed so that said first loop is in a separate plane from a second loop, said second loop being angled away from an axis of said first and second rods when said rods are extended, and said second loop being angled toward an opposite one of said rods when said rods are folded flat against each other;

wherein a center of said first loop is offset from an axis of the rod said first loop is attached to, and an end of said second loop is offset from an axis of the rod said second loop is attached to, such that said end of said second loop intersects said center of said first loop to allow said rods to fold flat against each other when folded.

11. An auger comprising:

a first bar;

a second bar coupled to the first bar at a non-detachable joint; and a spiral blade on an end of the second bar opposite the joint;

wherein said first bar is foldable to a right angle with respect to said second bar, so that said first bar can be used to screw said second bar into the ground.

* * * * *